US006556209B2

(12) United States Patent
Kondo

(10) Patent No.: US 6,556,209 B2
(45) **Date of Patent: *Apr. 29, 2003**

(54) MEMORY APPARATUS OF DIGITAL VIDEO SIGNAL

(75) Inventor: Tetsujiro Kondo, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/728,894

(22) Filed: Oct. 10, 1996

(65) Prior Publication Data

US 2003/0043162 A1 Mar. 6, 2003

(30) Foreign Application Priority Data

Oct. 13, 1995 (JP) ..... 7-291868

(51) Int. Cl.[7] ..... G09G 5/04

(52) U.S. Cl. ..... 345/550; 345/555; 345/600; 345/572

(58) Field of Search ..... 345/150–156, 345/186, 199–200, 202, 200.34, 507, 508, 510, 132, 549, 555, 550, 545, 532, 531, 564, 572, 600; 348/568, 567, 231, 233

(56) References Cited

U.S. PATENT DOCUMENTS

| | | | | | |
|---|---|---|---|---|---|
| 4,580,134 | A | * | 4/1986 | Campbell et al. | 345/152 |
| 4,583,184 | A | * | 4/1986 | Murase | 364/518 |
| 5,039,983 | A | * | 8/1991 | Yoon | 340/763 |
| 5,065,144 | A | * | 11/1991 | Edelson et al. | 345/153 |
| 5,079,544 | A | * | 1/1992 | Demont et al. | 345/150 |
| 5,081,450 | A | * | 1/1992 | Lucas et al. | 345/155 |
| 5,142,272 | A | * | 8/1992 | Kondo | 345/186 |
| 5,379,410 | A | * | 1/1995 | Okada | 395/575 |
| 5,420,608 | A | * | 5/1995 | Choi et al. | 345/186 |
| 5,434,957 | A | * | 7/1995 | Moller | 345/431 |
| 5,515,077 | A | * | 5/1996 | Tateyama | 345/153 |
| 5,604,917 | A | * | 2/1997 | Saito et al. | 395/869 |
| 5,668,599 | A | * | 9/1997 | Cheney et al. | 348/402 |

* cited by examiner

*Primary Examiner*—Lun-Yi Lao
(74) *Attorney, Agent, or Firm*—Frommer Lawrence & Haug LLP; William S. Frommer; Bruno Polito

(57) ABSTRACT

A memory apparatus of a digital video signal for storing color compressed video data is disclosed, the color compressed video data being compressed video data that represents components of three primary colors, the memory apparatus comprising a memory portion for storing the color compressed video data and a color restoring portion for restoring the color compressed video data into original video data, wherein said color restoring portion is disposed on a semiconductor substrate that is used in common with said memory portion.

9 Claims, 4 Drawing Sheets

MEMORY APPARATUS OF DIGITAL VIDEO SIGNAL

BACKGROUND OF THE INVENTION

1. Field of the Invention

The present invention relates to a memory apparatus of a digital video signal, in particular, the apparatus having a signal processing circuit that restores an encoded video signal on real time basis, the signal processing circuit being built in an IC circuit.

2. Description of the Related Art

As display data for a color video display in for example computer graphics, tone values of three primary colors R (red), G (green), and B (blue) of a color picture are digitized. The number of colors that can be displayed depends on the number of bits of the display data.

In conventional computer graphics systems, the number of colors that can be displayed per pixel (this number is also referred to as color display performance) is for example 256 ($=2^8$). However, when a color picture with a high color display performance that is captured by a color video camera, a color image scanner, or the like is displayed, it is insufficient to display it with a display performance of 256 colors. To improve the display performance, for example eight bits are assigned to each of three primary colors R, G, and B (thus, a total of 24 bits are assigned as display data to each pixel). Thus, a color display performance of $2^{24}=16,777,216$ colors is obtained.

However, in a high resolution display unit with for example 2048×2048 pixels, if 24 bits are assigned to each pixel, the amount of data necessary for displaying one color picture becomes huge as calculated in the following.

$$24 \times 2048 \times 2048 = 100,663,296 \text{ (bits)} = 12,582,912 \text{ (bytes)} = 12 \text{ (Megabytes)}$$

Such huge data is not easily stored in a memory, a record medium, or the like. Thus, even with a hard disk, only several pictures can be stored. In addition, to send and edit the data, it will take a long time. Thus, it is considered that this method is impractical.

To solve this problem, the number of bits per pixel is suppressed to for example eight bits. In addition, 256 colors are selected from many colors so as to display as many color as possible. The selected colors are used in a form of a conversion table that is referred to as a color look-up table (CLUT). Application software is modified so that it only uses the selected 256 colors. In this method, normally, such a look-up table (LUT) comprises an input data register, a data conversion memory, and an output data register. However, when the look-up table is used, 256 colors are selected from for example $2^{24}$ colors. The selected 256 colors are displayed at a time. Thus, when more colors than 256 colors are required, this method is insufficient.

To solve such a problem, the applicant of the present invention has proposed a technology disclosed as U.S. Pat. No. 5,142,272 (issued on Aug. 25, 1992) (corresponding to Japanese Patent Laid-Open Publication No. 63-287992). The proposed technology is a color restoring apparatus. In the color restoring apparatus, with display data of a color picture composed of data of a color with the maximum tone change of adjacent pixels and data of an identification code that represents the color, data that is read from a display memory corresponding to the identification code is maintained until data of the same color is read from the display memory. Thus, with the color restoring apparatus, data can be converted into data with more bits than the original data through a mapping operation.

According to the color restoring apparatus, since a video memory only stores display data, the required capacity of the memory can be prevented from increasing. For example, in an application as with a computer game, a required number of digital pictures are written from a CD-ROM to the memory. The application software accesses the memory so as to display pictures in full colors.

Generally, when the conversion table referred to as the look-up table (LUT) is used, the memory that stores the video data and the conversion table are structured as different IC circuits. Thus, the space necessary for the IC circuits adversely increases.

In the color restoring apparatus that restores color compressed video data, a memory that stores the color compressed video data and a signal processing circuit that receives data read from the memory and generates full-color video data as with the structure of which 24 bits are assigned to each pixel are structured as different IC circuits. Thus, the space necessary for the IC circuits adversely increases.

Moreover, since a memory apparatus for use with conventional computers can be random-accessed, an address signal should be generated. Thus, an address generator that generates the address signal for random-accessing data of the memory is required.

OBJECTS AND SUMMARY OF THE INVENTION

Therefore, an object of the present invention is provide a memory apparatus of a digital video signal, the memory apparatus having a signal processing circuit that restores encoded video data in such a manner that the signal processing circuit is disposed on (built in) a semiconductor substrate of a video memory IC circuit that has a memory that stores the encoded video data, thereby reducing the size and cost of the apparatus.

Another object of the present invention is to provide a memory apparatus of a digital video signal, the memory apparatus having a signal processing circuit that restores compressed video data to data with a plurality of components in such a manner that the signal processing circuit is disposed on a semiconductor substrate of a video memory IC circuit that has a memory that stores compressed video data represented with the plurality of components that have been encoded therewith, thereby reducing the size and cost of the apparatus.

To solve the above-described problem, the present invention is a memory apparatus of a digital video signal for storing color compressed video data, the color compressed video data being compressed video data that represents components of three primary colors, the memory apparatus comprising a memory portion for storing the color compressed video data and a color restoring portion for restoring the color compressed video data into original video data, wherein the color restoring portion is disposed on a semiconductor substrate that is used in common with the memory portion. Thus, the scale of the hardware can be reduced. In addition, the space of the apparatus can be reduced.

The present invention is a memory apparatus of a digital video signal for storing input data, the memory apparatus comprising a memory portion for storing the input data that is represented with a plurality of encoded components that have been encoded therewith, and a restoring portion for restoring the compressed video data to the original plurality of components, wherein the restoring portion is disposed on a substrate that is used in common with the memory portion.

The present invention is a memory apparatus of a digital video signal for storing input data, the input data being compressed video data, the memory apparatus comprising a memory portion for storing the compressed video data, and a restoring portion for restoring the compressed video data to an original video signal, wherein the restoring portion is disposed on a substrate that is used in common with the memory portion. Thus, since the data is compressed, the storage capacity of the memory can be reduced. In addition, the scale of the hardware can be further reduced. Moreover, the space of the apparatus can be reduced.

The present invention is the memory apparatus further comprising an address generating portion composed of a counter, wherein the counter is adapted for receiving a clock pulse and a reset signal and generating an address signal corresponding to a horizontal scanning operation and a vertical scanning operation of a television with the reset signal and the clock pulse. Thus, since video data is read from the video memory corresponding to the horizontal scanning operation and the vertical scanning operation of the television, the address generator can be simply composed of a counter or the like that uses the reset signal and the clock pulses.

These and other objects, features and advantages of the present invention will become more apparent in light of the following detailed description of a best mode embodiment thereof, as illustrated in the accompanying drawings.

DETAILED DESCRIPTION OF THE PREFERRED EMBODIMENT

Next, with reference to the accompanying drawings, an embodiment of the present invention will be described. It should be noted that the present invention is not limited to the following embodiment. Instead, any video signal may be used as long as the present invention is an one-chip video memory IC circuit that has a restoring circuit that restores compressed video data into data with a plurality of components in such a manner that the restoring circuit is disposed on a semiconductor substrate of a video memory IC circuit that has a semiconductor memory that stores compressed video data represented with the plurality of components that are directly encoded corresponding to the correlation thereof.

Figure 1:
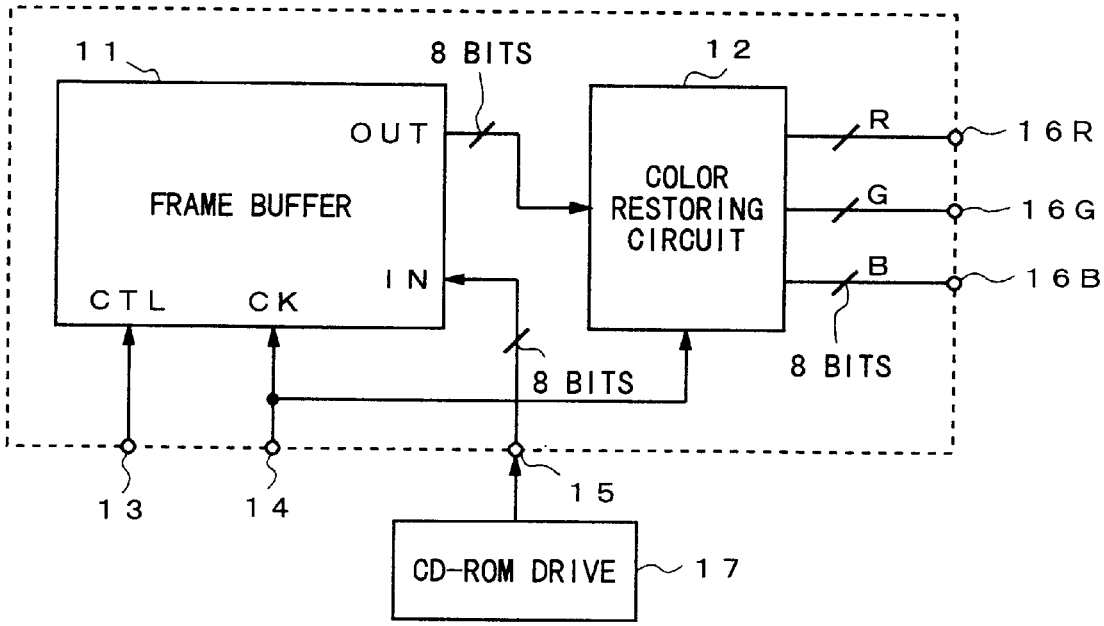
FIG. 1 is a block diagram schematically showing the overall structure of an embodiment of the present invention.

FIG. 1 shows the entire block of a video memory IC circuit 10. In FIG. 1, the video memory IC circuit 10 has a frame buffer 11 and a color restoring circuit 12 on the same substrate. In other words, as denoted by dotted lines, the frame buffer 11 and the color restoring circuit 12 compose a one-chip video memory IC circuit.

The frame buffer 11 has a video data storing portion and an address generating circuit that is composed of a counter. A memory control signal is supplied from an input terminal 13. The memory control signal is a synchronous signal that represents the beginning of a frame. In addition, a clock pulse is supplied from an input terminal 14. The clock pulse is also supplied to the color restoring circuit 12. Thus, the common clock pulse causes the frame buffer 11 and the color restoring circuit 12 to operate.

Next, the operations of the frame buffer 11 and the color restoring circuit will be described. The counter in the frame buffer 11 is reset by the memory control signal. The counter counts the number of times the clock pulse is supplied. In other words, when the counter is reset, a picture frame is read or written to/from the memory. Thereafter, the counter counts the number of times the clock pulse is supplied so as to successively generate an address signal for the memory. The address signal corresponds to the horizontal scanning operation and the vertical scanning operation of the television. The video data storing portion of the frame buffer 11 writes or reads video data corresponding to the address signal supplied from the counter. The video memory IC circuit is a memory that stores video data. Since the video memory is accessed for video data (namely, data is written or read) corresponding to the horizontal scanning operation and the vertical scanning operation of the television, it is not necessary to random- access data. Thus, the address generating circuit can be simply composed of the counter or the like. Thereafter, video data read from the frame buffer 11 is supplied to the color restoring circuit 12 (that will be described later). The color restoring circuit 12 executes the restoring process corresponding to the timing of the clock pulse.

When a plurality of pictures (frames) are stored, a plurality of video memory IC circuits shown in FIG. 1 are disposed in parallel. Alternatively, with a plurality of frame buffers and color restoring circuits connected thereto, an IC circuit that processes a plurality of frames can be structured. Compressed digital video data read from for example a CD-ROM drive 17 is input to the frame buffer 11 through an input terminal 15.

Digital video data supplied from the CD-ROM drive 17 is color compressed data corresponding to a predetermined algorithm that will be described later. For example, data for each pixel is compressed to eight bits. The digital video data has been written to the frame buffer 11 before the frame buffer 1 is accessed. The writing operation is performed with the memory control signal and the address signal received from the counter corresponding to the clock pulse.

The digital video data (eight bits per pixel) that has been color compressed is read from the frame buffer 11 and supplied to the color restoring circuit 12. The color restoring circuit 12 restores the digital video signal to data of primary colors of R (red), G (green), and B (blue) each of which is composed of eight bits. The restored data of the primary colors is output from output terminals 16R, 16G, and 16B. Thus, a digital video signal of which data per pixel is composed of 24 bits is generated. The detailed structure of the color restoring circuit will be described later.

Figure 2:
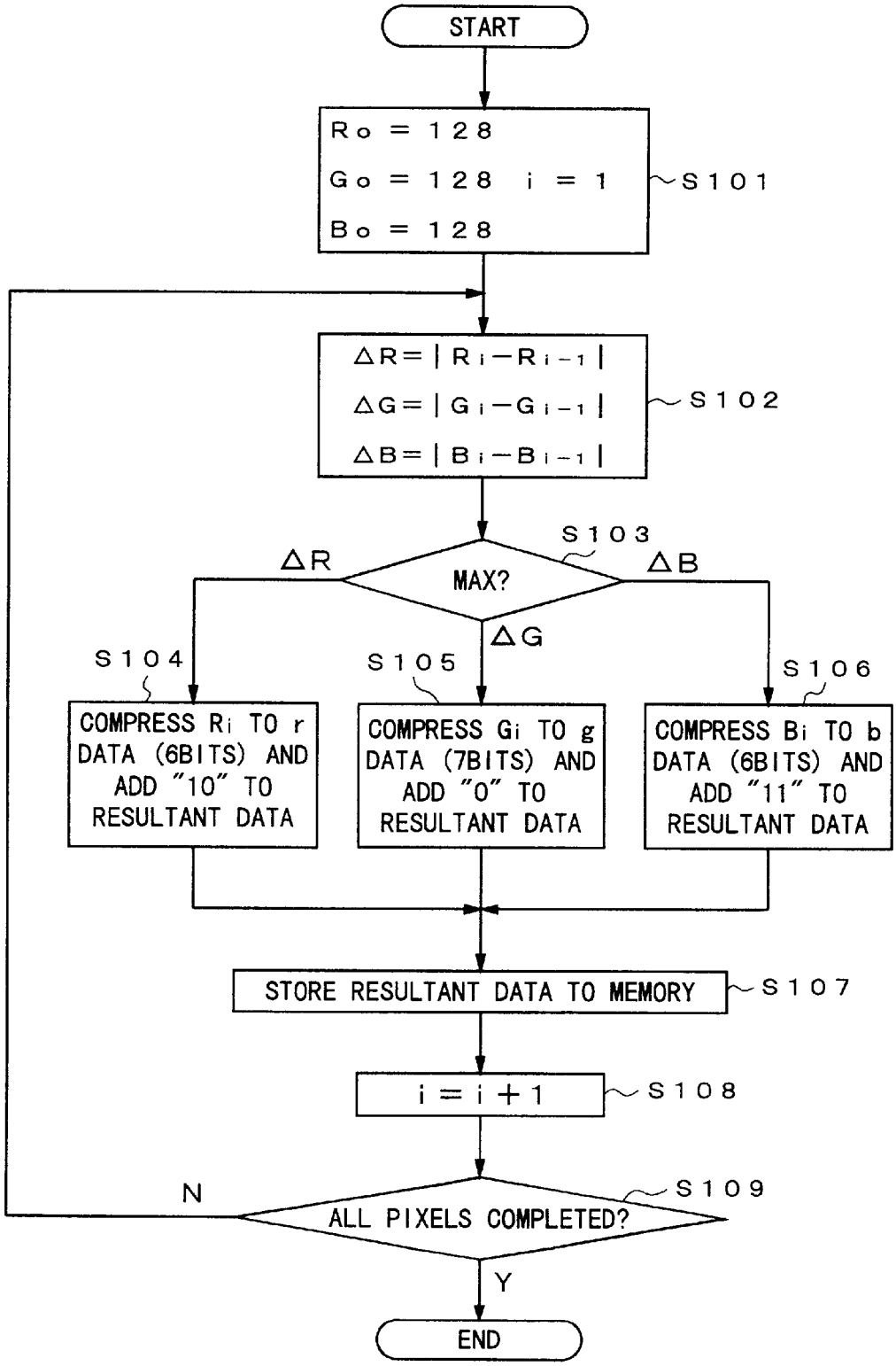
FIG. 2 is a flow chart showing a color compressing process according to the embodiment of the present invention.

Next, with reference to FIGS. 2 to 4, a color compressing process of digital video data supplied to the video memory IC will be described. FIG. 2 is a flow chart showing a data compressing process for each pixel of a color picture. The digital three-primary-color data R, G, and B corresponding to color tones of the three primary colors of the color picture are obtained by digitally converting original data that has not been compressed (namely, three primary color signals are captured by a video camera or the like). For example, the digital data of each color is composed of eight bits per color. (Thus, data of three primary colors is composed of a total of 24 bits.) The data of 24 bits per pixel composed of three-primary-color data R, G, and B is adaptively compressed. Thus, video data dd composed of eight bits per pixel is obtained.

Figure 3:
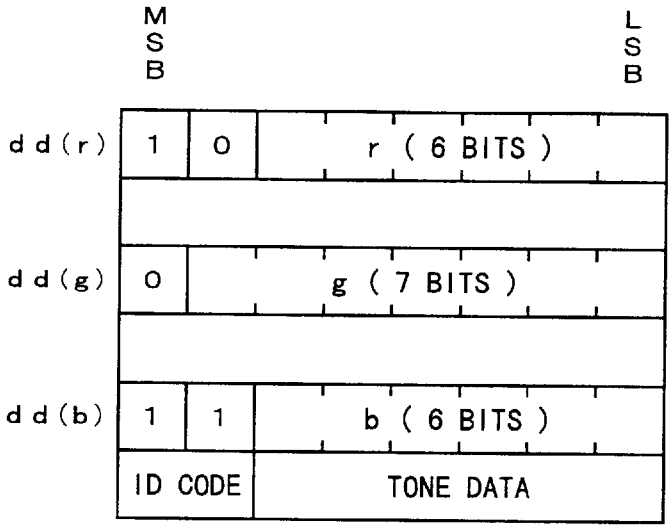
FIG. 3 is a schematic diagram showing an example of the format of color compressed data.
Figure 4:
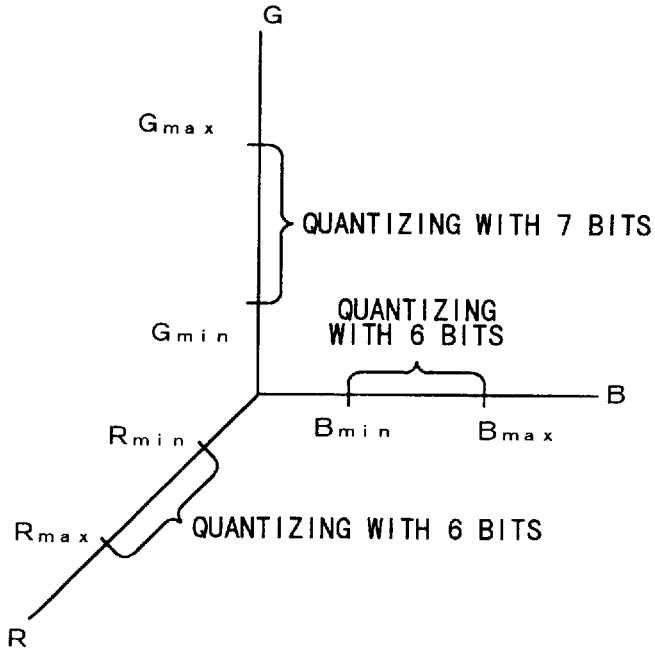
FIG. 4 is a schematic diagram for explaining a color restoring process.

The eight-bit video data dd has a format in which three types of compressed color data dd(r), dd(g), and dd(b) are defined corresponding to the three primary colors as shown in FIG. 3. The compressed color data in the format is generated in the following method. First, the absolute value of the difference of digital primary color data of adjacent pixels is calculated. One of three types of data corresponding to the maximum value of the absolute values is adaptively selected. As to the digital three-primary-color data R, G, and B shown in FIG. 2, three-primary-color data corresponding to i-th pixel on one screen is denoted by $R_i$, $G_i$, and $B_i$, respectively.

At step S101 shown in FIG. 2, initial values $R_0$, $G_0$, and $B_0$ of the digital three-primary color data R, G, and B are set as follows:

$R_0=128$, $G_0=128$, $B_0=128$

At this point, a count variable i (corresponding to the pixel number) is set to 1.

Thereafter, at step S102, the absolute values ΔR, ΔG, and ΔB of the differences between the primary color data $R_i$, $G_i$, and $B_i$ of the i-th pixel and the primary color data $R_{i-1}$, $G_{i-1}$, and $B_{i-1}$, of the (i−1)-th pixel that is adjacent to the i-th pixel are calculated as follows.

$$\Delta R=|R_i-R_{i-1}|$$

$$\Delta G=|G_i-G_{i-1}|$$

$$\Delta B=|B_i-B_{i-1}|$$

At step S103, the maximum value of ΔR, ΔG, and ΔB is determined. The digital primary color data corresponding to the color with the maximum value is compressed to color data composed of six bits or seven bits at step S104, S105, or S106. In addition, an identification code that represents the color and that is composed of one to two bits is added to the compressed data. Thus, eight-bit video data dd in the format shown in FIG. 3 is formed.

In other words, at step S103, when it has been determined that the value ΔR is the maximum (namely, ΔR>ΔG and ΔR>ΔB), the flow advances to step S104. At step S104, eight-bit digital red data $R_i$ is compressed to six-bit red data r. In addition, two bits "10" as an identification code for identifying red are added to the high order side (MSB side) of the data. Thus, eight-bit video data dd(r) is formed. Moreover, at step S103, when it has been determined that the value ΔG is the maximum (namely, ΔG>ΔR and ΔG>ΔB), the flow advances to step S105. At step S105. eight-bit digital green data $G_i$ is compressed to seven-bit green data g. In addition, one bit "0" as an identification code for identifying green is added to the high order side (MSB side) of the data. Thus, eight-bit video data dd(g) is formed. At step S103, when it has been determined that the value ΔB is the maximum (namely, ΔB>ΔR and ΔB>ΔG), the flow advances to step S106. At step S106, eight-bit digital blue data $B_i$ is compressed to six-bit blue tone data b. In addition, two bits "11" as a blue identification code are added to the high order side (MSB side). Thus, eight-bit video data dd(b) is formed.

Next, the theory of the above-described color data compressing method will be described. FIG. 4 shows a color space that can be represented by digital three-primary-color data R, G, and B, each of which is composed of eight bits. As shown in FIG. 4, assuming that in the case that a color picture obtained is developed into a color space, the maximum values of the three-primary-color components are $R_{max}$, $G_{max}$, and $B_{max}$ and the minimum values of thereof are $R_{min}$, $G_{min}$, and $B_{min}$, the three-primary-color data in these ranges is requantized to color data in the above-described format (the color data is composed of six bit or seven bits), thereby compress color data. In other words, since one color is represented with 19 bits, $2^{19}$=524,288 colors can be represented.

Color data r, g, and b are requantized using for example the following formulas.

$$r=(R-R_{min})\times 2^3/(R_{max}-R_{min}+1)$$

$$g=(G-G_{min})\times 2^3/(G_{max}-G_{min}+1)$$

$$b=(B-B_{min})\times 2^3/(B_{max}-B_{min}+1)$$

The compressed color data dd(r), dd(g), or dd(b) formed at step S104, S105, or S106 is stored as video data of the i-th pixel to the i-th address of the memory at step S107. Thereafter, the flow advances to step S108. At step S108, the count variable i is incremented by 1. Thereafter, the flow advances to step S109. At step S109, it is determined whether or not the above-described process has been performed for all the pixels. When the determined result as step S109 is NO, the flow returns to step S102. When the determined result at step S102 is YES, the process for all the screen is completed.

Figure 5:
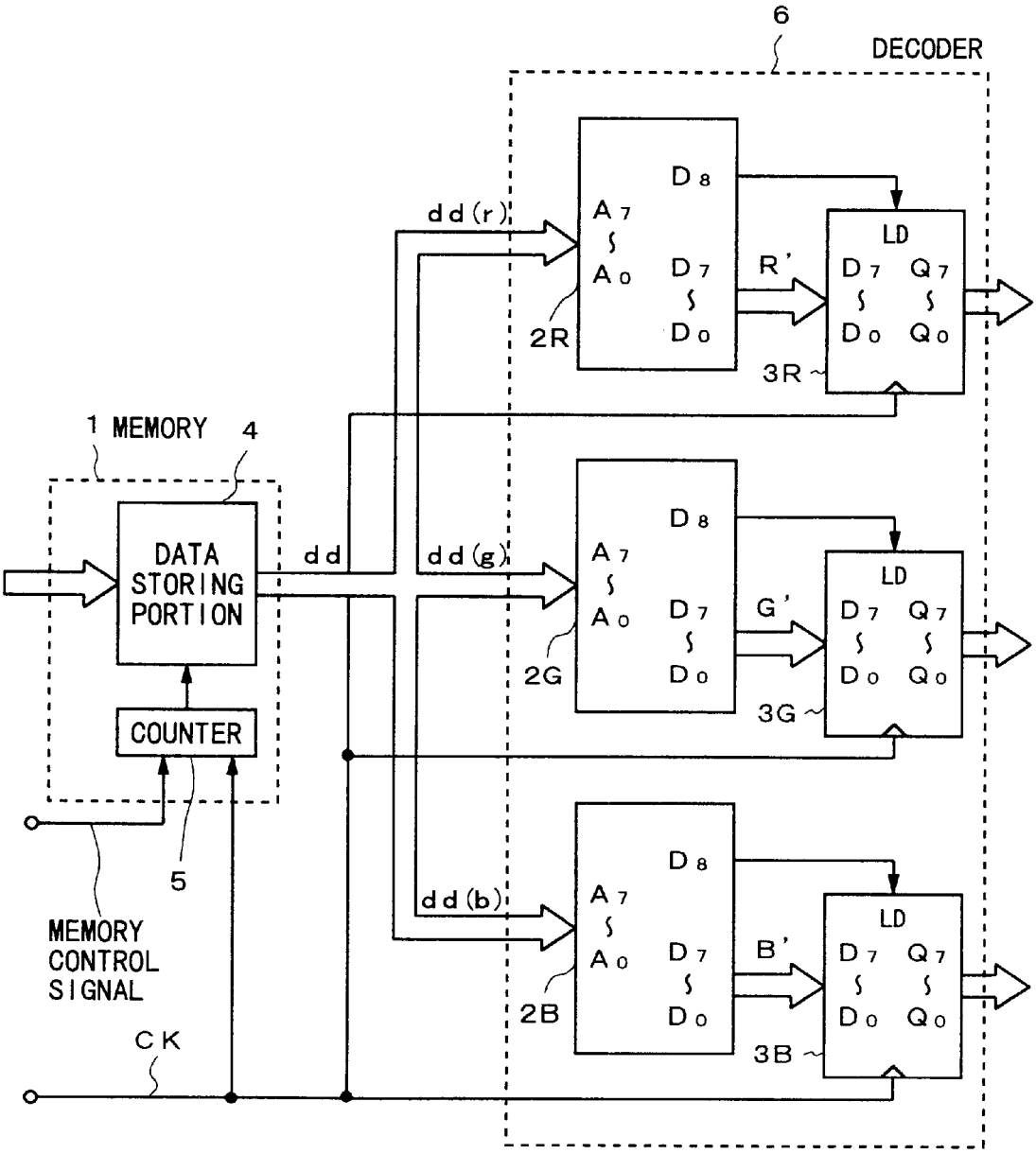
FIG. 5 is a block diagram showing the detail of a memory apparatus of a digital video signal corresponding to the embodiment of the present invention.

Next, the restoring process for restoring color video data that has been compressed in the above-described method into three-primary-color data will be described with reference to FIG. 5. FIG. 5 is a schematic diagram showing the detailed structure of the video memory IC circuit shown in FIG. 1. In particular, this structure corresponds to the frame buffer 11 and the color restoring circuit 12 shown in FIG. 1. FIG. 5 shows the detailed structure of the color restoring circuit 12. In FIG. 5, a memory 1 (corresponding to the frame buffer 11 shown in FIG. 1) has a video data storing portion 4 and a counter 5. The video data storing portion 4 has a storage capacity equivalent to the number of pixels of one screen times eight bits. The counter 5 generates an address signal. The counter 5 is reset with a memory control signal as a reset signal. The counter 5 supplies to the video data storing portion 4 an address that corresponds to the horizontal scanning operation and the vertical scanning operation of the television and that synchronizes with a clock signal CK. Thus, the video data dd (composed of eight bits per pixel) is read. In the video data storing portion 4 of the memory 1, the identification code and compressed tone data of a color that has the maximum level change (tone change) between adjacent pixels are stored as data dd. Eight-bit data dd read from the memory 1 is supplied to a decoder 6 (corresponding to the color restoring circuit 12 shown in FIG. 1). Thereafter, the eight-bit data dd is supplied to memories 2R, 2G, and 2B for color look-up tables as their addresses.

The memories 2R, 2G, and 2B for the color look-up tables each have 256 addresses so that eight-bit video data dd can be accessed. In addition, each address has a storage capacity of nine bits. The memory 2R for red has stored a predetermined conversion table for red. In the memory 2R for red, when the high order two bits $A_7$ and $A_6$ of eight bits $A_7$ to $A_0$ of an address become "10" that represents a red identification code value, the highest order bit $D_8$ of nine bits $D_0$ to $D_8$ of the output data becomes "1" that represents an update command. In addition, eight bits $D_7$ to $D_0$ of digital red data R' are output corresponding to tone data r supplied to low order six bits $A_5$ to $A_0$ of the address.

In reality, as data in the address space of the memory 2R, "1" is written to $D_8$. In addition, the red data R' of the color space corresponding to the six-bit tone data r is written to each of $D_7$ to $D_0$.

The memory 2G for green has registered a predetermined conversion table for green. In the memory 2G for green, when the highest order bit $A_7$ of eight bits $A_7$ to $A_0$ of an address becomes "0" that represents a green identification code value, the highest order bit $D_8$ of nine bits $D_0$ to $D_8$ of the output data becomes "1" that represents an update command. In addition, eight-bit digital green data G' is output as $D_7$ to $D_0$ corresponding to tone data g supplied to the low order seven bits $A_6$ to $A_0$ of the address.

In addition, the memory 2G for green has stored a predetermined conversion table for green. In the memory 2B for blue, when two high order bits $A_7$ and $A_6$ of eight bits $A_7$ to $A_0$ of an address become "11" that represents a blue identification code value, the highest order bit $D_8$ of nine bits $D_0$ to $D_8$ of the output data becomes "1" that represents an update command. In addition, eight-bit digital blue data B' are output as $D_7$ to $D_0$ corresponding to the tone data b supplied to the low order six bits $A_5$ to $A_0$ of the address.

It should be noted that a circuit that converts compressed tone data r, g, and b into digital primary-color data R', G', and B', each of which is composed of eight bits, may be used instead of using the memories 2R, 2G, and 2B for the color look-up tables.

Next, low order eight bits $D_7$ to $D_0$ of the memories 2R, 2G, and 2B (namely, digital red data R', digital green data G', and digital blue data B') are supplied to latches 3R, 3G, and 3B, respectively. In addition, the highest order bit $D_0$ of each of the memories 2R, 2G, and 2B is supplied as a latch enable signal to each of the latches 3R, 3G, and 3B. In addition, the clock signal CK is supplied as a timing signal to the latches 3R, 3G, and 3B. Thus, the color of which the highest order bit data $D_8$ is "0" is maintained as it is. The color of which the highest order bit data $D_8$ becomes "1" is updated to new data. These latches 3R, 3G, and 3B operate corresponding to the clock signal CK. Thus, digital three-primary-color data is obtained from the latches 3R, 3G, and 3B.

In the color compressing process, since six bits are assigned to each of red and blue and seven bits are assigned to green, video data of which eight bits are assigned to each pixel can be substantially represented with 19 bits. Thus, 524,288 ($=2^{19}$) colors can be simultaneously displayed on one screen. Consequently, a natural picture can be displayed with sufficient tones. As a result, a color picture can be naturally displayed with a good quality. In addition, since a color with a large tone change is displayed with a precedence, the deterioration of the resolution can be suppressed.

Therefore, since the present invention is a memory apparatus of a digital video signal, the memory apparatus having a signal processing circuit that restores encoded video data in such a manner that the signal processing circuit is disposed on (built in) a semiconductor substrate of a video memory IC circuit that has a memory that stores the encoded video data, the input register, the output data register, and so forth are commonly structured with the video memory, the restoring circuit, and so forth, thereby reducing the size and cost of the apparatus.

In addition, since the present invention is a memory apparatus of a digital video signal, the memory apparatus being structured as a one-chip video memory IC circuit that has a color restoring portion that restores color compressed video data to original video data in such a manner that the color restoring portion is disposed on a semiconductor substrate of a video memory IC circuit that has a memory portion that stores color compressed picture data that represents three-primary-color components, the storage capacity of the memory and the scale of the hardware can be reduced (in other words, since particular portions are commonly structured, they can be omitted). In addition, the space of the apparatus can be reduced.

Moreover, since the present invention is a memory apparatus of a digital video signal, the memory apparatus having a signal processing circuit that restores compressed video data to data with a plurality of components in such a manner that the signal processing circuit is disposed on a semiconductor substrate of a video memory IC circuit that has a memory that stores compressed video data represented with the plurality of components that have been encoded therewith, the storage capacity of the memory and the scale of the hardware can be reduced (in other words, since particular portions are commonly structured, they can be omitted). In addition, the space of the apparatus can be reduced.

Furthermore, since the video memory is accessed for video data (namely, the video data is written or read to/from the video memory) corresponding to the horizontal scanning operation and the vertical scanning operation of the television, the address generator can be simply composed of a counter or the like that uses a reset signal and a clock pulse.

It should be noted that the present invention is not limited to a circuit that compresses color data. Instead, with a luminance signal, color data or luminance data with the maximum tone change of adjacent pixels may be selected. Moreover, in the above-described embodiment, the encoding process for the color compression and color restoration was described. However, the present invention is not limited to such an encoding process. Instead, any video signal may be used as long as the present invention is an one-chip video memory IC circuit that has a restoring circuit that restores compressed video data into data with a plurality of components in such a manner that the restoring circuit is disposed on a semiconductor substrate of a video memory IC circuit that has a semiconductor memory that stores compressed video data represented with the plurality of components that are directly encoded corresponding to the correlation thereof.

Moreover, in the present invention, a one-chip IC circuit that has a restoring circuit that performs a signal process on real time basis on a semiconductor substrate of a video memory IC circuit that has a semiconductor memory that stores color compressed video data is exemplified. However, the present invention is not limited to such an IC circuit. Instead, the present invention may be a one-chip circuit that has a video memory that has a semiconductor memory that stores color compressed video data in such a manner that the video memory is built in a semiconductor substrate of a restoring circuit that performs a signal process on real time basis.

In addition, according to the present invention, a frame buffer is used as a video memory. However, the present invention is not limited to such a structure. Instead, a field buffer may be used as the video memory.

Since the present invention is a memory apparatus of a digital video signal, the memory apparatus having a signal processing circuit that restores compressed video data to data with a plurality of components in such a manner that the signal processing circuit is disposed on a semiconductor substrate of a video memory IC circuit that has a memory that stores compressed video data represented with the plurality of components that have been encoded therewith, the storage capacity of the memory and the scale of the hardware can be reduced. In addition, the space of the apparatus can be reduced.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A memory apparatus of a digital video signal for storing compressed video data, the compressed video data being derived from original video data representing a still image or a moving image and being compressed video data that represents components of three primary colors and luminance, the memory apparatus comprising:

a memory portion for storing compressed video data obtained by adaptively selecting one of three primary color signals and a luminance signal;

an address generation portion incorporating a counter for accessing the compressed video data stored in said memory portion; and a color restoring portion for restoring the stored compressed video data into said original video data, wherein said color restoring portion, said memory portion and said address generation portion are arranged on a single integrated circuit chip, wherein said counter counts pulses of a clock signal generated external to said chip and is reset by a memory control signal, and wherein upon restoration said compressed video data passes directly from said memory portion to said color restoring portion without passing through any elements external to said chip;

whereby said color restoring portion is responsive to said clock signal.

2. The memory apparatus as set forth in claim 1, wherein the color compressed video data is data of a color with the maximum tone change of adjacent pixels of three primary colors, an identification code that represents the color being added to the color compressed video data, and wherein said color restoring portion comprises:

a maintaining portion for maintaining data read from said memory portion; and a converting portion for converting the data read from said memory portion into color data with more bits than the video data read from said memory portion.

3. The memory apparatus as set forth in claim 2, wherein said converting portion is a look-up table to which the video data read from said memory portion is supplied as an address and from which color data with many bits than the video data read from said memory portion is read.

4. The memory apparatus as set forth in claim 1, wherein an address signal supplied from the counter corresponds to a horizontal scanning operation and a vertical scanning operation of a television.

5. A memory apparatus of a digital video signal for storing input data that represents video components of three primary colors and luminance, the memory apparatus comprising:

a memory portion for storing input data that has been obtained by adaptively selecting one of three primary color signals and a luminance signal;

an address generation portion incorporating a counter for accessing the input data stored in said memory portion; and a restoring portion for restoring the original video data by decoding said stored input data, wherein said restoring portion, said memory portion and said address generation portion are arranged on a single integrated circuit chip, wherein said counter counts pulses of a clock signal generated external to said chip and is reset by a memory control signal, and wherein upon restoration said input data passes directly from said memory portion to said restoring portion without passing through any elements external to said chip;

whereby said restoring portion is responsive to said clock signal.

6. The memory apparatus as set forth in claim 5, further comprising:

an input terminal for receiving the input data; and an output terminal for outputting data corresponding to the restored plurality of components.

7. The memory apparatus as set forth in claim 6, wherein the number of output terminals corresponds to the number of the plurality of components.

8. The memory apparatus as set forth in claim 5, wherein an address signal received from the counter corresponds to a horizontal scanning operation and a vertical scanning operation of a television.

9. A memory apparatus of a digital video signal for storing input data, the input data being compressed video data and the compressed video data being derived from original video data representing a still image or a moving image and representing components of three primary colors and luminance, the memory apparatus comprising:

a memory portion for storing input data obtained by adaptively selecting one of three primary color signals and a luminance signal;

an address generation portion incorporating a counter for accessing the input data stored in said memory portion; and a restoring portion for restoring the original video data by decompressing the stored input data, wherein said restoring portion, said memory portion and said address generation portion are arranged on a single integrated circuit chip, wherein said counter counts pulses of a clock signal generated external to said chip and is reset by a memory control signal, and wherein upon restoration said input data passes directly from said memory portion to said restoring portion without passing through any elements external to said chip;

whereby said restoring portion is responsive to said clock signal.

* * * * *